United States Patent [19]

Scott et al.

[11] Patent Number: 4,661,242

[45] Date of Patent: Apr. 28, 1987

[54] DILUENT DISTILLATION PROCESS AND APPARATUS

[75] Inventors: Jeffery E. Scott; David W. McDougall; Robert E. Heigold, all of Calgary, Canada

[73] Assignee: Delta Projects Inc., Calgary, Canada

[21] Appl. No.: 743,834

[22] Filed: Jun. 12, 1985

[51] Int. Cl.[4] ..... C10G 31/06

[52] U.S. Cl. ..... 208/177; 208/188; 208/347; 208/353; 208/356; 208/365; 208/368

[58] Field of Search ..... 208/188, 177, 178, 347, 208/349, 348, 353, 356, 365, 368

[56] References Cited

U.S. PATENT DOCUMENTS

| | | | |
|---|---|---|---|
| 2,933,447 | 4/1960 | Walker et al. | 208/177 |
| 3,402,124 | 9/1968 | Jones | 208/353 |
| 3,441,499 | 4/1969 | Francis, Jr. et al. | 208/187 |
| 4,040,958 | 8/1977 | Rammler | 208/177 |
| 4,127,393 | 11/1978 | Timmins et al. | 208/356 |
| 4,162,965 | 7/1979 | Clapper | 208/177 |
| 4,180,456 | 12/1979 | Moll et al. | 208/177 |
| 4,191,640 | 3/1980 | Chess et al. | 208/348 |
| 4,246,073 | 1/1981 | Umeda et al. | 208/353 |
| 4,313,819 | 2/1982 | Rado | 208/177 |
| 4,339,330 | 7/1982 | Fujiwara et al. | 208/188 |
| 4,396,498 | 8/1983 | Dente et al. | 208/177 |
| 4,455,221 | 6/1984 | Calderon et al. | 208/347 |
| 4,514,305 | 4/1985 | Filby | 208/188 |
| 4,539,099 | 9/1985 | Merchant et al. | 208/177 |

FOREIGN PATENT DOCUMENTS

| | | | |
|---|---|---|---|
| 1376367 | of 0000 | United Kingdom | 208/347 |
| 1518826 | 7/1978 | United Kingdom | 208/50 |
| 2036786 | 7/1980 | United Kingdom | 208/107 |
| 2111074 | 6/1983 | United Kingdom | 208/347 |
| 2134920 | 8/1984 | United Kingdom | 208/347 |
| 2093059 | 8/1984 | United Kingdom | 208/50 |

*Primary Examiner*—Andrew H. Metz
*Assistant Examiner*—Anthony McFarlane
*Attorney, Agent, or Firm*—Rogers, Bereskin & Parr

[57] ABSTRACT

An improvement in a process for the treatment of heavy oil in which a hydrocarbon diluent is subjected to distillation prior to its addition to a heavy oil production stream, to remove at least some of the light components in the diluent that would otherwise vaporize in the treatment process. A distillation unit for use in the process is also disclosed.

8 Claims, 2 Drawing Figures

DILUENT DISTILLATION PROCESS AND APPARATUS

FIELD OF THE INVENTION

This invention relates generally to the treatment of production fluids containing heavy oil and bitumen.

BACKGROUND OF THE INVENTION

Certain heavy liquid hydrocarbon streams are produced from natural deposits of bitumen in sand or from natural deposits of heavy conventional oil referred to as "heavy oil" or sometimes as "extra heavy oil". These streams are called "production fluids"; the hydrocarbon portion of the stream may be bitumen or heavy oil but, for convenience the term "heavy oil" will be used hereafter to include both such portions. Heavy oil production streams are viscous and do not flow readily except at elevated temperatures. Streams containing these materials also contain volatiles (e.g. natural gas), water and sand, all of which must be separated from the heavy oil in the stream.

DESCRIPTION OF THE PRIOR ART

In a typical conventional treatment process, free gas or vapour is first liberated from the production stream in a degassing vessel. Some sand may also be removed at this time. The remaining fluid is injected into a treatment unit including heat exchangers and separation equipment. Here, the balance of the sand is removed and the heavy oil is separated from the remaining liquid components of the stream and from any additional volatiles produced in the treatment unit. The treated oil can then be delivered to storage or other processing equipment.

The mechanisms of separation in the treatment unit depend strongly on the density and viscosity of the heavy oil, and separation is facilitated when the values of these properties are lowered. This is normally done by adjusting the operating temperature and by blending in lighter hydrocarbon streams referred to as diluent streams.

A diluent can be any miscible stream that is lighter than the heavy oil, but it must be relatively involatile or it will not stay in solution. A typical diluent is stabilized condensate (also referred to as pentanes plus or natural gasoline) and is produced in natural gas processing facilities. Other diluents could be light refinery streams such as naphtha. These products must have a vapour pressure below atmospheric pressure so that they will not vapourize when stored in atmospheric storage tanks. Therefore they contain hexane and heavier components and limited amounts of lighter components such as pentanes and butanes so they do not exceed the maximum allowable vapour pressure.

Before mixing with the hot process stream the diluent is normally below 38° C. When mixed, its temperature increases significantly causing the lighter components such as butanes and pentanes to vapourize. These vapour components act as a stripping vapour to bring along steam and even heavier components such as hexane and heptane.

The vapour phase caused by adding diluent must be separated and disposed of. While the vapour may be used to fuel process burners, it contains hydrocarbon components with product values significantly higher than their fuel values. It is therefore advantageous to minimize the production of vapour in the treatment unit or to recover the valuable components from the vapour.

In the prior art, vapour losses have been reduced by using heavier diluents having lower concentrations of the lighter components such as butanes and pentanes. However, heavy diluents may not be readily available and some so-called heavy diluents, which are so named because they have relatively high densities (such as 0.75 specific gravity at 150° C.) still contain light hydrocarbons that will generate vapour in the treatment unit.

Most heavy oil treatment plants include a vapour recovery unit that condenses and separates varying amounts of the vapour produced in the treatment unit. Condensed hydrocarbons are recombined and cooled with the treated oil leaving the treatment unit, and condensed steam or water flows to other processing equipment.

SUMMARY OF THE INVENTION

An object of the present invention is to provide an improvement in a process for the treatment of a heavy oil production stream, which includes the addition of a diluent to the stream. Broadly, the improvement involves subjecting the diluent to distillation prior to its addition to the production stream to remove at least some of the light components in the diluent that would vapourize during said treatment. The diluent is then separated into a liquid stream and a vapour stream and the liquid stream is introduced into the treated oil stream to provide the required diluent addition. Preferably, the vapour stream is subjected to condensation and is introduced into the treated oil stream downstream of the location at which treatment of the production stream takes place.

In summary, the process provided by the invention involves removal of most or all of the volatile components in the diluent that might otherwise vapourize during treatment of the production stream as a result of the relatively high operating temperatures required during such treatment. In the absence of light diluent components, the heavy diluent components, at typical treatment temperatures and pressures, will not form a stripping vapour, or will form less stripping vapour than would the light components, if present. Further, in the absence of a significant amount of stripping vapour, the quantity of water and heavier hydrocarbons that would vapourize with the stripping vapour is reduced so that all downstream processing equipment will perform more efficiently to minimize the overall loss of diluent.

Accordingly, it is believed that the process provided by the invention will result in significantly reduced usage of diluent and loss of valuable components from the production stream, as compared with equivalent traditional processes.

The invention also provides an apparatus for producting heavy oil from a heavy oil production stream including a treatment unit for receiving the stream and removing volatiles, water and sand, and diluent supply means for adding a diluent to said stream. The improvement provided by the invention comprises a diluent distillation unit upstream of said treatment unit and including means for heating the diluent to vapourize at least some of the light components in the diluent that would vapourize in said treatment unit; means for separating the heated diluent into a liquid stream and a vapour stream; and means for subjecting said vapour stream to condensation. First and second conduit means are provided. The first conduit means delivers the liquid stream to the treatment unit to provide the required diluent addition while the second conduit means delivers the vapour stream (preferably mainly in condensed form) into the treated oil stream downstream from the treatment unit.

The treatment unit itself may be of essentially conventional form and will typically include heat exchangers and separation equipment for removal of volatiles, water and sand from the production stream.

BRIEF DESCRIPTION OF THE DRAWINGS

In order that the invention may be more clearly understood, reference will now be made to the accompanying drawings which illustrate a heavy oil treatment apparatus in accordance with the invention, as contrasted with an equivalent traditional apparatus.

In the drawings.

DESCRIPTION OF THE PRIOR ART APPARATUS

Figure 1:
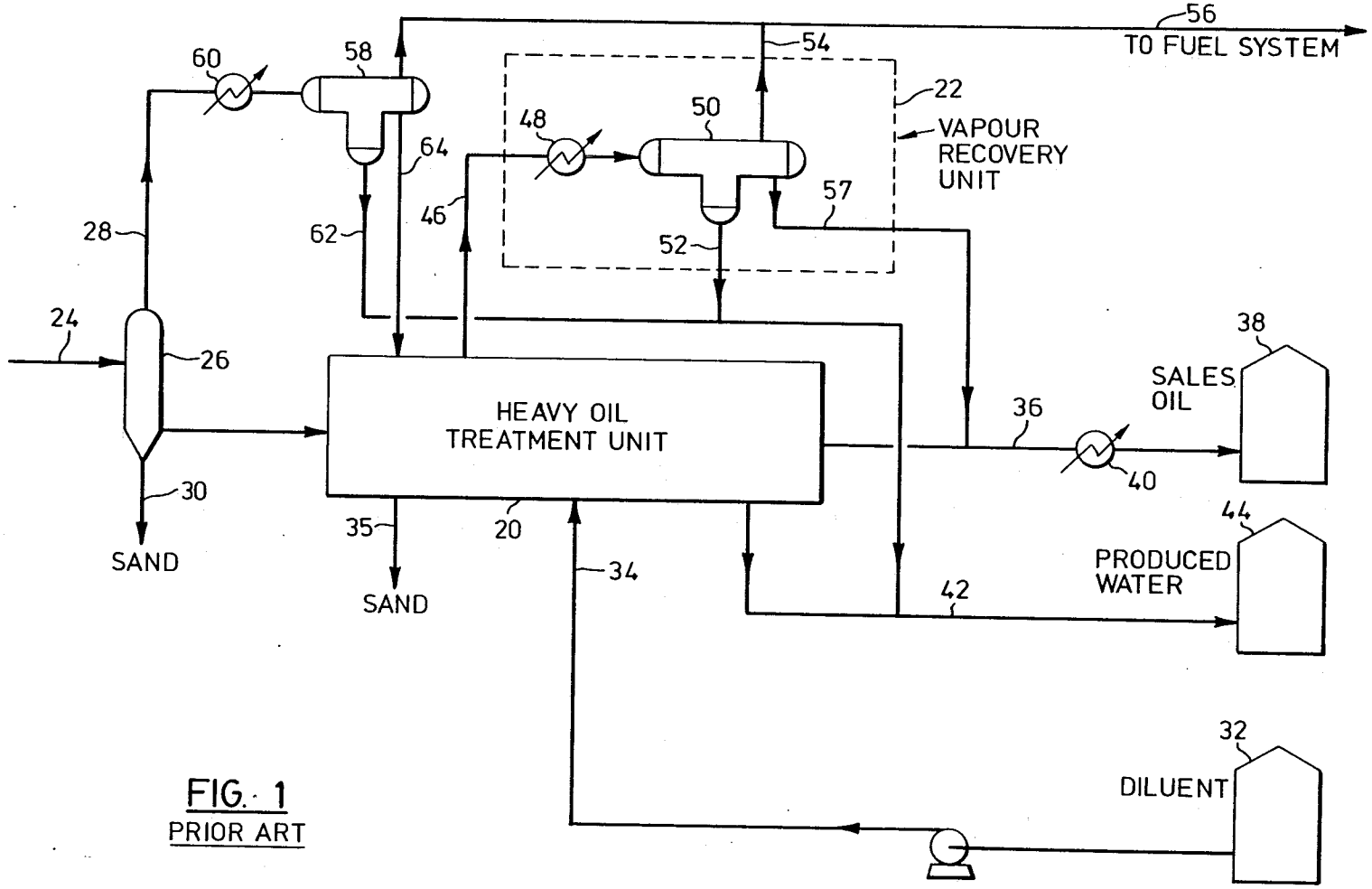
FIG. 1 PRIOR ART
FIG. 1 is a diagrammatic illustration of the traditional apparatus.

The apparatus shown in FIG. 1, includes a heavy oil treatment unit generally denoted by reference numeral 20 and a vapour recovery unit 22. An incoming heavy oil production stream is indicated by line 24 and is delivered first to a degasser 26 in which free gas or vapour is separated from the production stream; the vapour leaves degasser 26 through a line 28. Some sand may also be removed in the degasser as indicated at 30. In the treatment unit 20, a diluent is added to the heavy oil stream from a diluent supply 32. The diluent stream itself is indicated at 34.

Treatment unit 20 includes heat exchangers and separation equipment as are well known in the art. Here, the balance of the sand is removed from the production stream at 35. The production stream is separated into a vapour stream 46, a water stream 42 and a treated oil stream 36, which leaves the treatment unit for delivery to other processing equipment or storage as represented at 38. A cooler in that stream is denoted 40.

A water stream leaving the treatment unit is denoted 42 and again flows to storage or other processing equipment indicated at 44. A vapour stream leaving the treatment unit is denoted 46. As explained previously, the traditional method of dealing with this vapour stream is to simply cool and partly condense the vapour in a vapour recovery unit 22. In a practical example, the vapour stream was found to leave the treatment unit at 130° C. Unit 22 includes a cooler 48 and a phase separator 50. The vapour stream was cooled to approximately 65.6° C. in cooler 48. Separator 50 is a three-phase separator which receives the cooled vapour from cooler 48 and separates the vapour into a water stream 52, a vapour stream 54 and a liquid hydrocarbon stream 57. Stream 52 connects to the water stream 42 leaving the treatment unit and stream 57 connects to the treated oil stream 36. The vapour stream 54 connects with a main vapour stream 56 and the waste vapour leaving the system would normally be used for fuel. Stream 56 also receives vapour from a phase separator 58 in the degasser output line 28. That line also includes a cooler 60. Water removed in separator 58 leaves along a stream denoted 62 which couples with the main water output stream 42. Light hydrocarbons removed in separator 58 are delivered in a stream 64 to the treatment unit 20.

Table 1 below indicates the volumes and contents of the principal streams in FIG. 1, namely the production stream 24, the diluent supply stream 34, the vapour output stream 56, the treated oil stream 36, and the water output stream 42. The values shown in Table 1 will be compared with corresponding values shown in Table 2 for the apparatus provided by the invention. That apparatus is shown in FIG. 2, which will now be described.

DESCRIPTION OF PREFERRED EMBODIMENT

Figure 2:
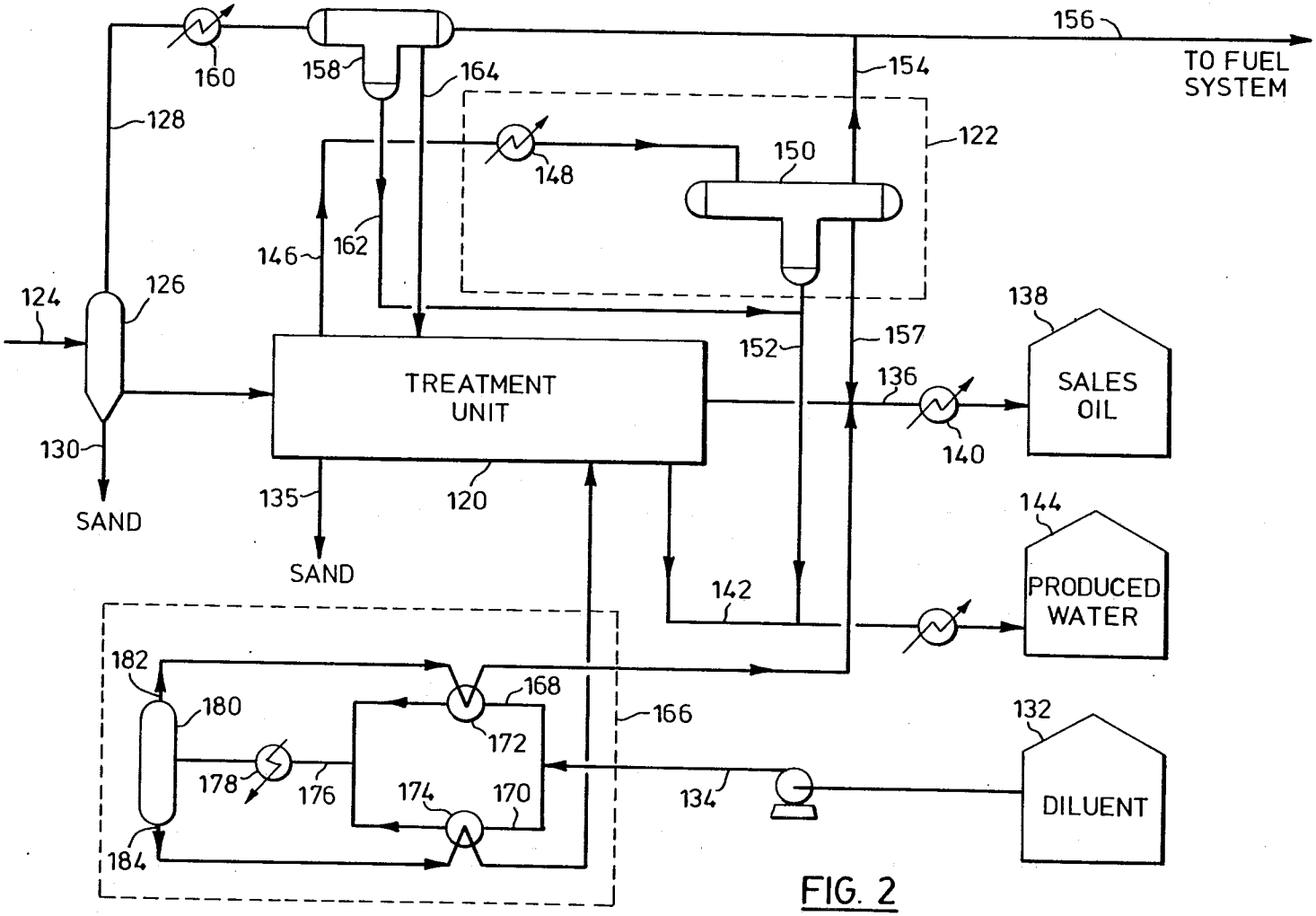
FIG. 2 is a corresponding illustration of the apparatus provided by the invention.

In FIG. 2, parts which are the same as parts described in connection with FIG. 1 will be denoted by the same reference numerals prefaced by the number "1". For example, the principal streams in FIG. 2 are the heavy oil production stream 124, the diluent stream 134, the vapour output stream 156, the treated heavy oil stream 136 and the water output stream 142. The treatment unit is denoted 120 and has associated therewith a vapour recovery unit 122 including a cooler 148 and a three-phase separator 150.

In the apparatus of FIG. 2, the flow of the heavy oil stream is as discussed previously in connection with FIG. 1. Briefly, the stream flows first through a degasser 126 in which gas and sand are removed and then into the treatment unit 120 which again is essentially conventional. The treated oil stream 136 leaves the treatment unit and vapour and water leave in streams 146 and 142 respectively. The vapour stream is cooled in cooler 148 and passes to a phase separator 150 where water, liquid hydrocarbon and vapour streams 152, 157 and 154 respectively are produced.

As discussed previously, the traditional process thus far described is improved in accordance with the invention in that the diluent stream 134 is processed prior to entering the treatment unit to distill out lighter components which would otherwise tend to vapourize in the treatment unit. This process is performed in a diluent distillation unit generally indicated by reference numeral 166. Diluent from a supply 132 is pumped into the unit 166 where it is split into two streams 168 and 170. Stream 168 is warmed in a heat exchanger 172 and stream 170 is warmed in a heat exchanger 174. The two warmed streams then recombine to form a stream 176 which is further heated in a heater 178. The stream leaving heater 178 will be a two-phase stream of vapour and liquid and is delivered to a phase separator 180 where the stream is separated into a vapour phase and a liquid phase. The vapour phase (referred to as distillate) leaves the separator as a stream 182 and is cooled and condensed by heat exchange with the incoming stream 168 in heat exchanger 172. The cooled distillate stream 182 is then injected into the treated heavy oil production stream 136 leaving the treatment unit 120.

The liquid stream leaving phase separator 180 (referred to as distilled diluent) leaves the separator as a stream 184 and is cooled in heat exchanger 174 by heat exchange with the incoming diluent stream 170. The cooled liquid stream then flows to the treatment unit 120 where it is blended with the production stream. Since the light components have been distilled out of the diluent, little or no vapour will be generated in the treatment unit. Any vapour that is generated will be processed in the vapour recovery unit 122.

It will be noted that, in both FIG. 1 and FIG. 2, the vapour recovery unit (22 or 122) is a simple cooler and separator. In the prior art arrangement shown in FIG. 1, the vapour recovery unit is generally relatively ineffective. While it is recognized that there may be better methods of vapour recovery such as combinations of vapour compression, or cooling with a refrigerant and fractionation of the condensing hydrocarbons, these elaborations of the basic vapour recovery unit are costly and generally not implemented. It is believed that the process provided by the present invention will eliminate the need for an elaborate vapour recovery system or will maximize the vapour that can be recovered with any vapour recovery system.

In a practical example of the apparatus shown in FIG. 2, diluent was heated to 163.3° C. in heater 178 and the vapour phase or distillate in stream 182 was cooled to 25.6° C. in heat exchanger 172. The liquid phase or distilled diluent stream 184 was cooled to 129.1° C. in heat exchanger 174 before delivery to the treatment unit 120. A relatively small quantity of vapour was generated in the treatment unit and was delivered to the vapour recovery unit as stream 146. The stream was cooled to 34.4° C. and partly condensed in cooler 148.

The volumes and contents of the principal streams are shown in Table 2 below. Comparing the results shown in Table 2 with the results achieved in a practical example of the traditional approach to heavy oil treatment (Table 1), it will be seen that, in the traditional approach, 279 kilograms per hour of diluent is lost to the system in the vapour output stream 56. It is recognized that this loss could be reduced by cooling to lower temperatures in cooler 48 (FIG. 1). However, this is not normally practical without employing a fractionation system to lower the amount of methane that would be injected into the oil, so that it is stable at atmospheric pressure.

In contrast, the process provided by the invention resulted in a loss of only 56 kilograms per hour of diluent in the vapour output stream 156. Compared with the loss of 279 kilograms per hour of diluent lost in the traditional system, this represents a reduction in diluent losses of 223 kilograms per hour.

As noted previously, in addition to reduced diluent losses, distilling the diluent in accordance with the invention also results in a more effective (or less expensive) vapour recovery system. In the above example, the heat removed by the cooler for the traditional approach without distillation was found to be 1261 kw compared with 250 kw for the process of the invention. In practical terms, the additional capital costs of the diluent distillation unit is balanced by reduced capital cost for the vapour recovery unit. However, the significant savings are in reduced diluent consumption.

TABLE NO. 1

(FIG. 1)

| | Total Gross Production | Diluent Required | Total Vapour From Unit | Treated Oil | Produced Water |
|---|---|---|---|---|---|
| Stream No. | 24 | 34 | 56 | 36 | 42 |
| Flow, kg/h | | | | | |
| Gas | 9696 | — | 9565 | 65 | 66 |
| Steam | 8037 | — | 53 | — | — |
| Bitumen | 74687 | — | 9 | 74678 | — |
| Diluent | — | 26713 | 279 | 26434 | — |
| Water | 331528 | — | — | 380 | 339132 |
| Total | 423948 | 26713 | 9906 | 101557 | 339198 |

TABLE NO. 2

(FIG. 2)

| | Total Gross Production | Diluent Required | Total Vapour From Unit | Treated Oil* | Produced Water |
|---|---|---|---|---|---|
| Stream No. | 124 | 134 | 156 | 136 | 142 |
| Flow, kg/h | | | | | |
| Gas | 9696 | — | 9525 | 60 | 111 |
| Steam | 8037 | — | 47 | — | — |
| Bitumen | 74687 | — | 9 | 74678 | — |
| Diluent | — | 26490 | 56 | 26434 | — |
| Water | 331528 | — | — | 380 | 339138 |
| Total | 423948 | 26490 | 9637 | 101552 | 339249 |

*The treated oil stream meets product specifications.

It should of course be understood that the embodiment shown in FIG. 2 is given by way of example only and that many modifications are possible within the broad scope of the invention.

For example, the described arrangement of heat exchangers 172, 174 and heater 178 in the diluent distillation unit 166 is not essential. For example, the incoming diluent does not have to exchange heat with the distillate or distilled diluent before it is heated in the heater 178. The distillate stream 182 could be cooled and condensed by heat exchange with some other process stream or with a cooling medium. Likewise, the distilled diluent stream 184 can be cooled by heat exchange with a process stream other than the incoming diluent.

Different methods of diluent distillation can be employed. For example, a stripping agent such as steam could assist in the distillation; two or more stages of vapour separation could be employed instead of the single stage described. The second and subsequent separation stages would involve reducing the pressure of the liquid stream from the first stage and separating the stream into a second stage liquid stream and a second stage vapour stream. This would normally require that the incoming diluent be pumped to a higher pressure. Alternatively, the diluent could be distilled in a fractionation tower, which makes possible a multitude of alternatives; for example, a stripping tower without reflux, or the addition of an overhead condenser and refluxing the condensed phase to the tower. The condenser can be an integral part of the fractionation tower, or separate, in which case a reflux accumulator and and reflux pumps would be required. The raw diluent would be fed directly to the distillation column without being preheated (the normal heating effect within the column would then cause the required vapourization), or it could be preheated either by heat exchange with distilled diluent or with some other process stream or source of external heat.

It should be emphasized that distillation of the diluent may be effected by any appropriate means available, of which the above are examples. In designing an actual system, a key design parameter will be the level of distillation that is required to reduce the vapour formation in the treatment unit to an acceptable level. Preferably, substantially all components should be distilled that have a relative volatility greater than a value of 1 at the operating conditions of the treatment unit.

Finally, it should be noted that it is not essential to subject the vapour stream leaving the phase separator 180 of the distillation unit to condensation prior to introducing the stream into the treated production stream. The vapour stream could be injected directly into the treated production stream and cooled together with the production stream. In that event, some condensation will inevitably take place in the line between the distillation unit and the production stream. Even where condensation is employed, the stream may not be wholly condensed.

Similarly, it is not essential that the liquid diluent stream leaving the distillation unit be cooled prior to entering the treatment unit.

We claim:

1. In a process for the treatment of a heavy oil stream to remove volatiles, water and sand, in which a hydrocarbon diluent containing light components is added to the stream; the improvement which comprises:

heating the diluent prior to its addition to the heavy oil stream to vaporize at least some of the light components in said diluent;

separating the heated diluent into a liquid stream and a vapour stream;

introducing said liquid stream into said heavy oil stream prior to said treatment of the heavy oil stream to remove volatiles, water and sand; and, introducing the vapour stream into the treated heavy oil stream downstream of the location at which the stream is treated to remove volatiles, water and sand.

2. A process as claimed in claim 1, wherein said vapour stream is subjected to condensation prior to its introduction into the heavy oil stream.

3. A process as claimed in claim 2, wherein said step of subjecting the vapour stream to condensation is performed by bringing the vapour stream into heat exchange relationship with the diluent prior to said step of heating the diluent.

4. A process as claimed in claim 1, wherein said liquid stream is cooled by bringing the stream into heat exchange relationship with the diluent prior to said step of heating the diluent.

5. A process as claimed in claim 1, wherein said diluent is separated into two streams prior to said step of heating the diluent and each said stream is brought into heat exchange relationship with one of said liquid stream and said vapour stream.

6. A process as claimed in claim 1, wherein the liquid stream is subjected to at least one further separation step by reducing the pressure of the liquid stream and separating the stream into a second stage liquid stream and a second stage vapour stream, said second stage liquid stream being introduced into the heavy oil stream and said second stage vapour stream being introduced into the treated oil stream downstream of the location at which said treatment takes place.

7. A process as claimed in claim 1, wherein said steps of heating the diluent and separating the heated diluent into a liquid stream and a vapour stream are performed in a fractionation column.

8. A process as claimed in claim 1, wherein said step of heating the diluent is controlled to vapourize substantially all light components in the diluent that have a relative volatility greater than one at the operating conditions at which the stream is treated to remove the volatiles, water and sand.

* * * * *